US005345610A

United States Patent [19]

Belanger

[11] Patent Number: 5,345,610

[45] Date of Patent: Sep. 13, 1994

[54] MITTEN SET

[76] Inventor: Judy A. Belanger, 20 Grove St., Springvale, Me. 04083

[21] Appl. No.: 51,771

[22] Filed: Apr. 26, 1993

[51] Int. Cl.[5] ..... A41D 19/00

[52] U.S. Cl. ..... 2/158; 2/159; 2/170; 242/379.2

[58] Field of Search ..... 2/158, 159, 160, 170, 2/16, 17, 161.1; 242/96; 119/96, 106; 273/26 A

[56] References Cited

U.S. PATENT DOCUMENTS

| | | | |
|---|---|---|---|
| 2,493,977 | 1/1950 | Kochman | 2/160 X |
| 2,555,203 | 5/1951 | Ramsey | 2/160 X |
| 3,854,640 | 12/1974 | Willmarth | 242/96 X |

FOREIGN PATENT DOCUMENTS

| | | | |
|---|---|---|---|
| 2036938 | 2/1972 | Fed. Rep. of Germany | 2/158 |
| 2903535 | 8/1980 | Fed. Rep. of Germany | 2/159 |
| 2221607 | 2/1990 | United Kingdom | 2/159 |
| 2241869 | 9/1991 | United Kingdom | 2/160 |

*Primary Examiner*—Clifford D. Crowder
*Assistant Examiner*—Gloria Hale
*Attorney, Agent, or Firm*—E. Michael Combs

[57] ABSTRACT

A mitten set is arranged to include a first, second, and third glove member to permit simultaneous warming and securement between an adult and an associated child, wherein the first glove member is a first sizing, and the second glove member a second sizing greater than the first sizing. The first glove member and the second glove member each include respective first and second glove member fingers, and the third glove member includes a third glove member finger, as well as a second entrance opening arranged to receive a hand of a child therethrough to permit securement of the individual child within the third glove member to thereby share the third glove member by an associated adult and child.

3 Claims, 4 Drawing Sheets

MITTEN SET

BACKGROUND OF THE INVENTION

1Field of the Invention

The field of invention relates to glove structure, and more particularly pertains to a new and improved mitten set wherein the same provides for a plurality of mittens arranged for use in combination to provide warmth to a child and adult, with a third glove member shared by a child and an adult for warmth and securement of the child relative to the adult.

2Description of the Prior Art

Glove members of various types are utilized throughout the prior art, wherein two-handed mitten structure is exemplified in the U.S. Design No. 255,505. Mitten and glove structure arranged for use in combination is set forth in the U.S. Pat. Nos. 4,195,405, with 3,735,421 employing a fur skinned mitten structure.

The instant invention is arranged to overcome deficiencies of the prior art by providing for the mitten set to provide for the unison warming and securement of a child and adult.

SUMMARY OF THE INVENTION

In view of the foregoing disadvantages inherent in the known types of mitten structure now present in the prior art, the present invention provides a mitten set wherein the same employs first, second, and third glove members, with the third glove member provided with a plurality of entrance openings to receive a plurality of hands therein. As such, the general purpose of the present invention, which will be described subsequently in greater detail, is to provide a new and improved mitten set which has all the advantages of the prior art glove structure and none of the disadvantages.

To attain this, the present invention provides a mitten set arranged to include a first, second, and third glove member to permit simultaneous warming and securement between an adult and an associated child, wherein the first glove member is a first sizing, and the second glove member a second sizing greater than the first sizing. The first glove member and the second glove member each include respective first and second glove member fingers, and the third glove member includes a third glove member finger, as well as a second entrance opening arranged to receive a hand of a child therethrough to permit securement of the individual child within the third glove member to thereby share the third glove member by an associated adult and child.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mitten set which has all the advantages of the prior art mitten structure and none of the disadvantages.

It is another object of the present invention to provide a new and improved mitten set which may be easily and efficiently manufactured and marketed.

It is a further object of the present invention to provide a new and improved mitten set which is of a durable and reliable construction.

An even further object of the present invention is to provide a new and improved mitten set which is susceptible of a low cost of manufacture with regard to both materials and labor, and which accordingly is then susceptible of low prices of sale to the consuming public, thereby making such mitten sets economically available to the buying public.

Still yet another object of the present invention is to provide a new and improved mitten set which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
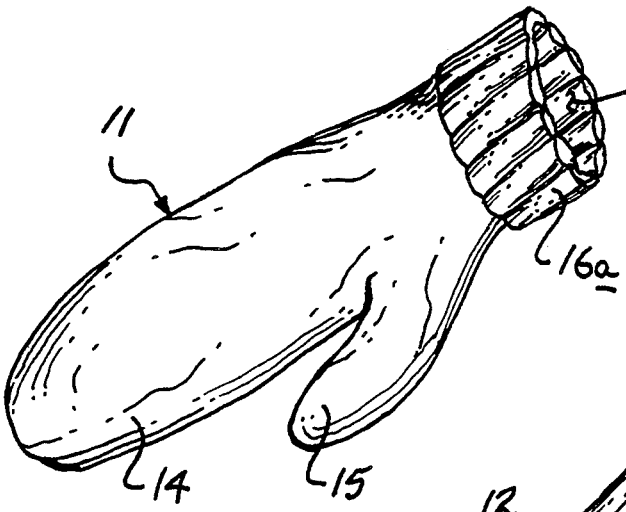
FIG. 1 is an isometric illustration of the first glove member.
Figure 2:
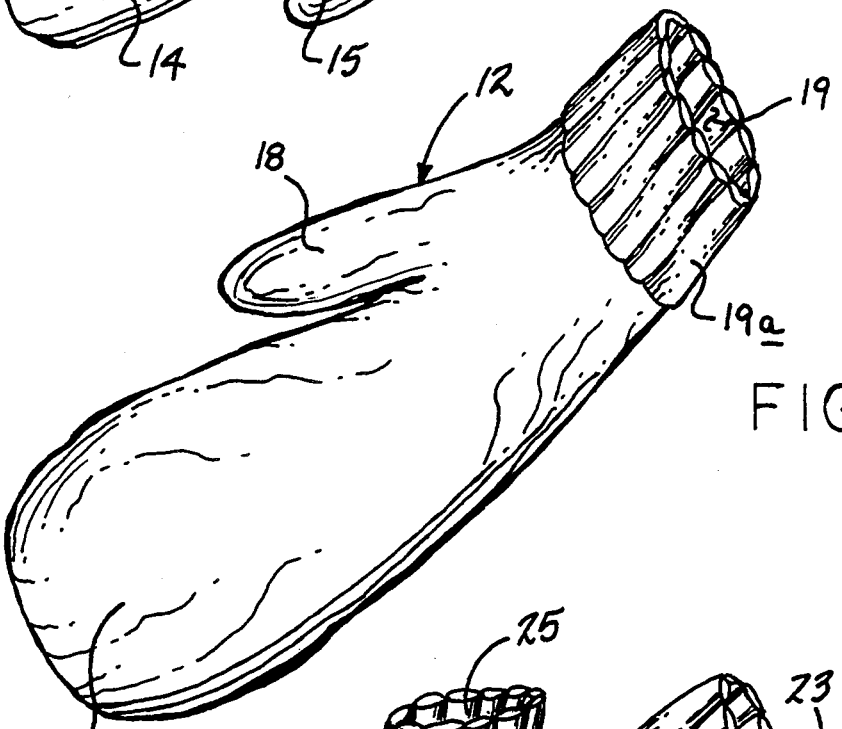
FIG. 2 is an isometric illustration of the second glove member.

With reference now to the drawings, and in particular to FIGS. 1 to 9 thereof, a new and improved mitten set embodying the principles and concepts of the present invention and generally designated by the reference numeral 10 will be described.

Figure 4:
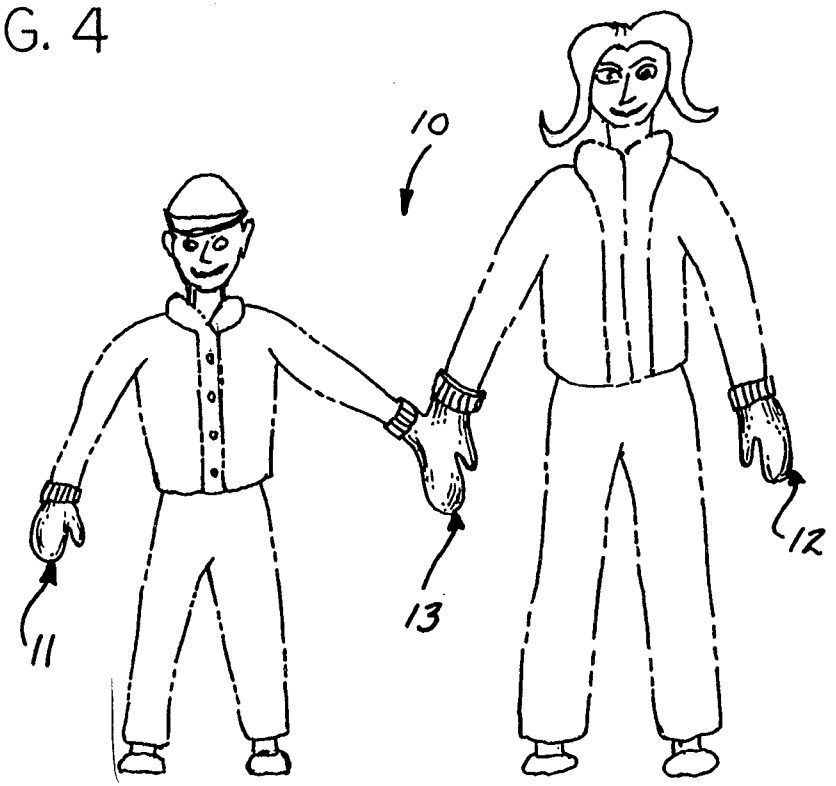
FIG. 4 is an isometric illustration of the mitten set in use .

More specifically, the mitten set 10 of the instant invention essentially comprises a first glove member 11 of a first sizing defining a first volume, with a second glove member 12 of a second sizing having a second volume greater than the first volume, and a third glove member 13 having a third volume greater than said second volume. The first glove member 11 includes a first glove body 14 having a first glove body finger member 15 and a first glove body entrance opening 16, having a first glove body entrance opening resilient ring 16*a* effecting constriction of said entrance opening to secure an individual's wrist therethrough. The second glove member 12 having a second glove body 17 includes a second glove body finger 18 and a second glove body entrance opening 19, having a second glove body entrance opening resilient ring 19*a*. The third glove member 13 including a third glove member body 20 and a third glove body first finger 21 that is positioned to a first side of the third glove body 20. A third glove body entrance opening 23 having a third glove body entrance opening resilient ring 23*a* is provided, with a third glove body second entrance opening 24 positioned to a second side of the third glove body 20, with the second entrance opening 24 having a second entrance opening resilient ring 25. The second entrance opening resilient ring 25 is arranged to receive a child's hand within the third glove body 13, in a manner as indicated in FIG. 4, in addition to an adult's hand permitting securement of the child's hand therewithin, as well as providing for warmth to each individual.

Figure 3:
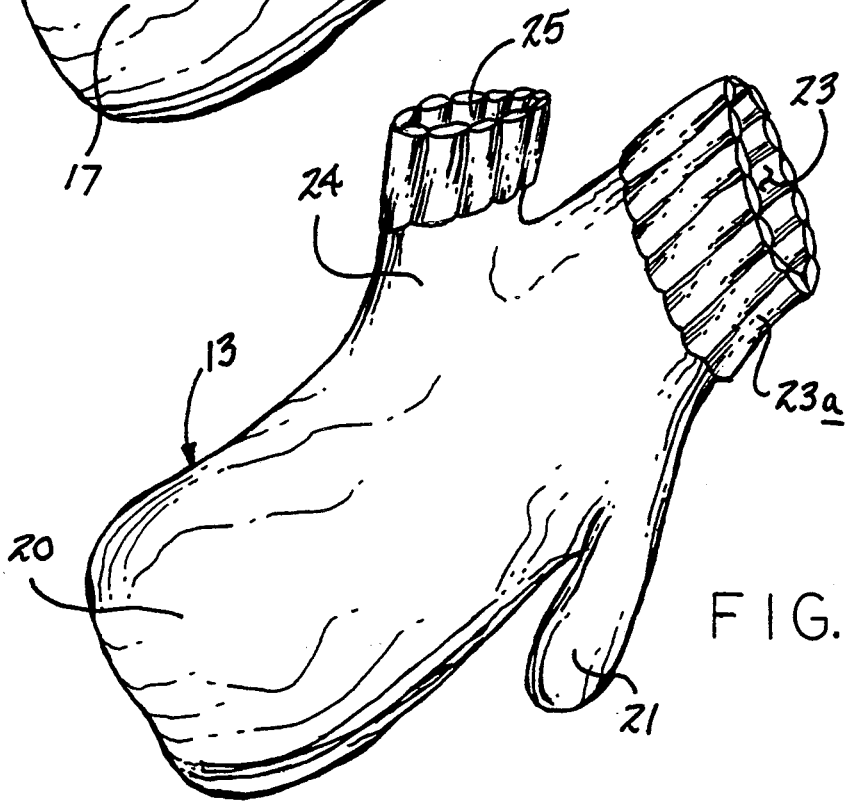
FIG. 3 is an isometric illustration of the third glove member.
Figure 5:
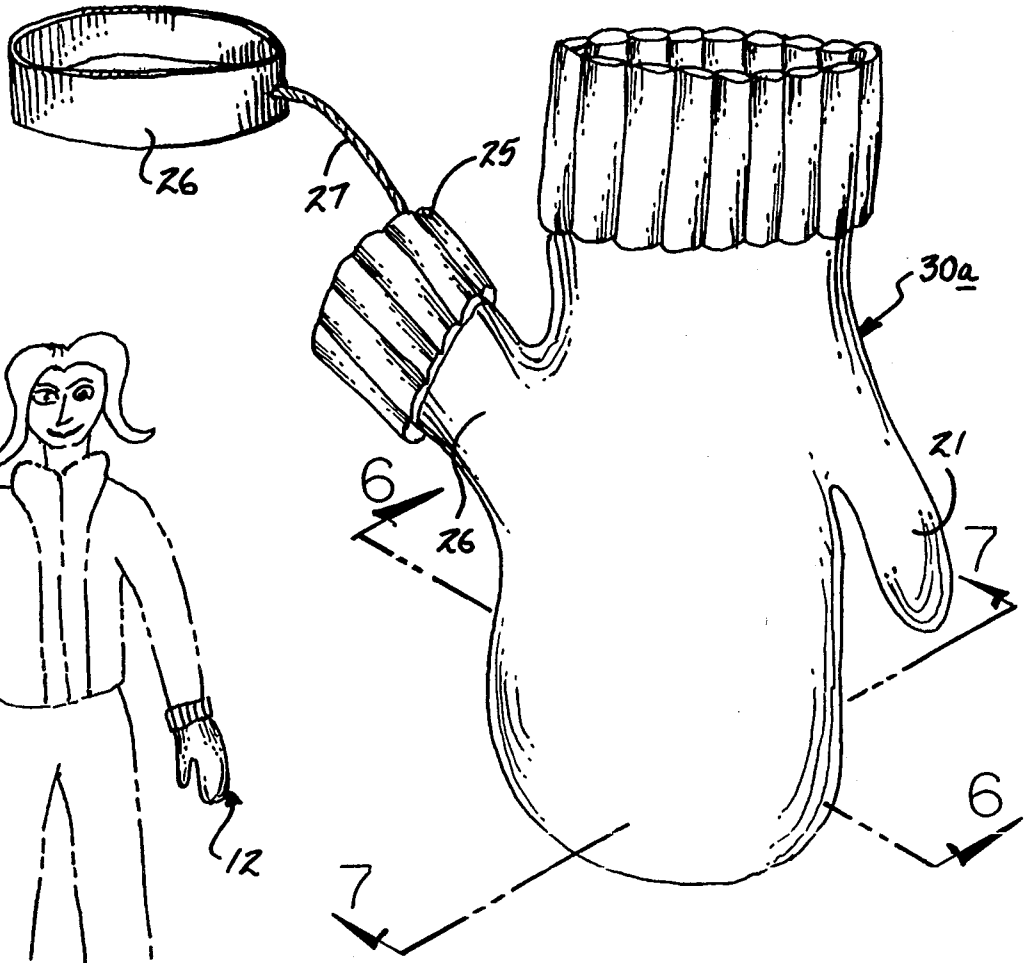
FIG. 5 is an isometric illustration of a modified third glove member.
Figure 6:
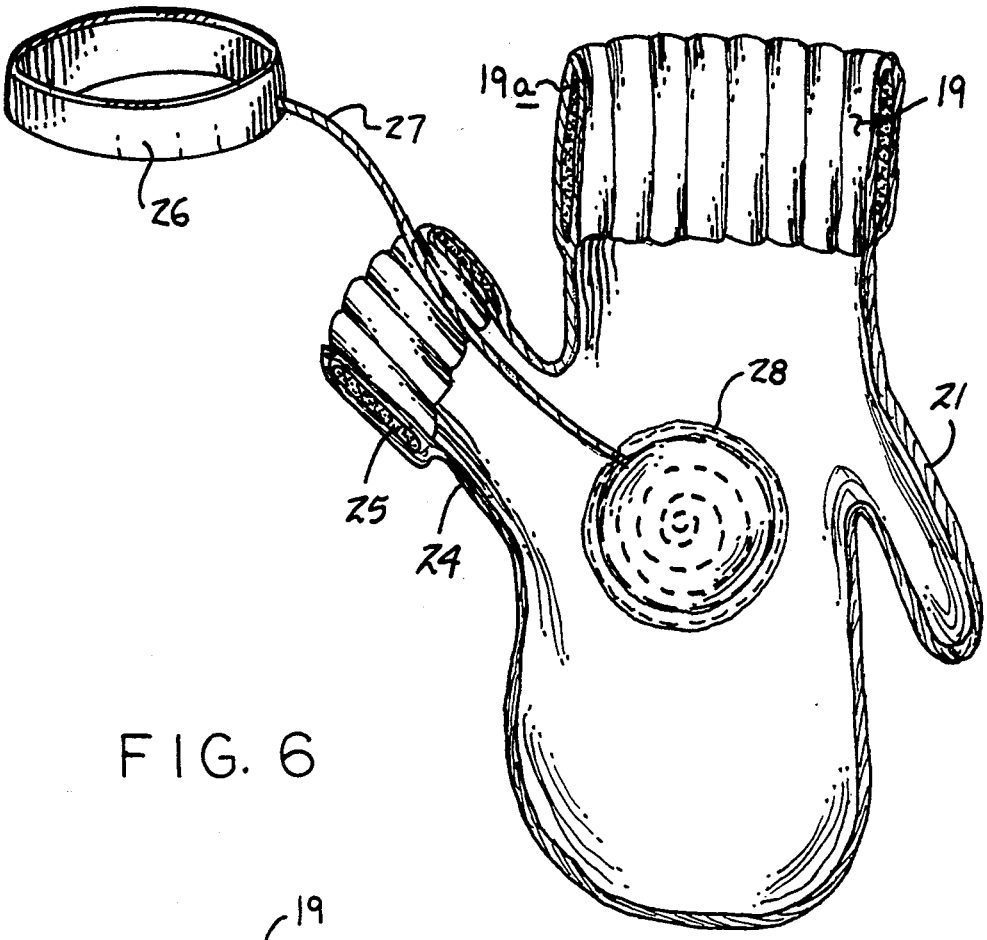
FIG. 6 is an orthographic view, taken along the lines 6—6 of FIG. 5 in the direction indicated by the arrows.
Figure 7:
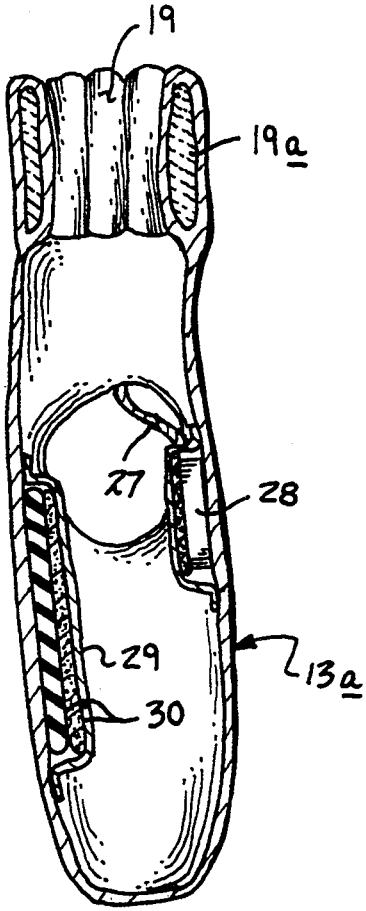
FIG. 7 is an orthographic view, taken along the lines 7—7 of FIG. 5 in the direction indicated by the arrows.

The FIG. 5 indicates the use of a modified third glove member 13*a* that, in addition to the structure as indicated relative to FIG. 3, employs a resilient wrist ring 26, having a tether line 27 mounted to the wrist ring 26 at a first end of the tether line, with a second end of the tether line directed through the second entrance opening 24 and received about a spring loaded tether reel 28 mounted within the third glove body, in a manner as indicated in the FIGS. 6 and 7. Further, the modified third glove member 13*a* is arranged to include a cushion housing 29, including a resilient cushion member 30 or a plurality thereof to provide for constriction within the third glove member when only an adult's hand is directed therewithin to thereby enhance securement of the glove body about the individual hand positioned within the third glove body.

Figure 8:
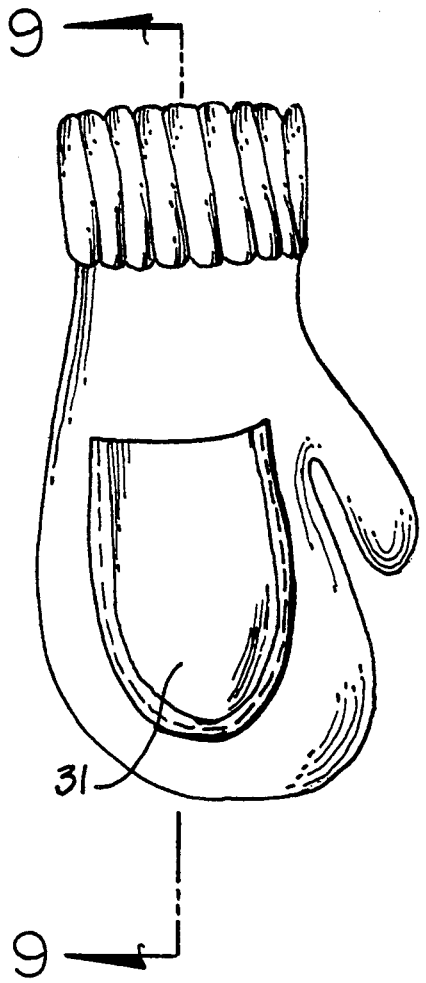
FIG. 8 is an isometric illustration of a first or second glove member arranged to employ an exterior pocket to receive a heating member.
Figure 9:
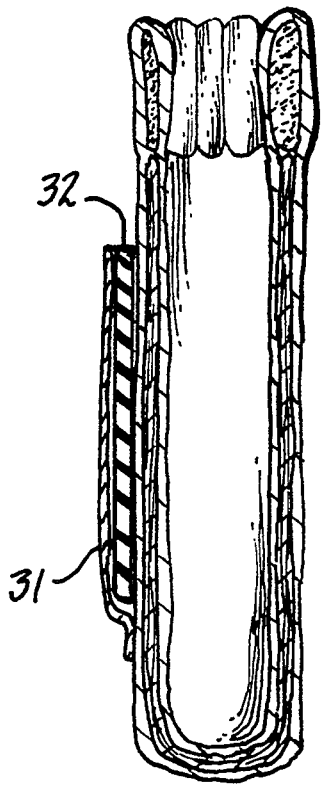
FIG. 9 is an orthographic view, taken along the lines 9—9 of FIG. 8 in the direction indicated by the arrows.

The FIGS. 8 and 9 indicate the use of a glove body outer pocket 31. The glove body outer pocket is arranged for mounting to the exterior surface of the first or second glove bodies 14 and 17 to receive a flexible heating member 32 therewithin. In this manner, the flexible heating member 32 is heated from a convenient source such as upon a stove or the like, and then inserted within the pocket 31 for additional heating of the glove body and an individual's hand positioned therewithin.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A mitten set, comprising, a first glove member of a first sizing defining a first volume within the first glove member.
and a second glove member having a second sizing defining a second volume within the second glove member,
and a third glove member having a third sizing defining a third volume within the third glove member, wherein the second volume is greater than said first volume and said third volume is greater than said second volume,
and the first glove member includes a first glove body, the second glove member having a second glove body, and the third glove member having a third glove body, the third glove body including a third glove body finger extending into the third glove body to a first side of the third glove body, and a third glove body entrance opening directed into the third glove body, wherein the third glove body entrance opening is positioned in adjacency to the third glove body finger, and the third glove body further including a second entrance opening directed into the third glove body in adjacency to the third glove body entrance opening, wherein the second entrance opening is positioned to a second side of said third glove body in an opposed orientation relative to said third glove body finger,
and the third glove body includes a tether reel positioned within the third glove body between the third globe body finger and the third glove body second entrance opening, and the tether reel having a tether extending therefrom, the tether directed through the third glove body second entrance opening and terminating in a resilient wrist ring, wherein the wrist ring is positioned exteriorly of the third glove body.

2. A mitten set as set forth in claim 1 wherein the third glove body further includes a cushion housing positioned within the third glove body, with the tether reel positioned to a first side of the second entrance opening, and the cushion housing positioned with the third glove body to a second side of the third glove body second entrance opening, and the cushion housing having a resilient compressible cushion member positioned therewithin.

3. A mitten set as set forth in claim 2 wherein the first glove member and the second glove member are each arranged to include an outer pocket, wherein said outer pocket is arranged to receive a flexible heating member arranged for reception within said outer pocket.

* * * * *